US006262567B1

(12) United States Patent
Bartlett

(10) Patent No.: US 6,262,567 B1
(45) Date of Patent: Jul. 17, 2001

(54) AUTOMATIC POWER SUPPLY SENSING WITH ON-CHIP REGULATION

(75) Inventor: Donald M. Bartlett, Fort Collins, CO (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 08/904,736

(22) Filed: Aug. 1, 1997

(51) Int. Cl.[7] ..... G05F 5/00

(52) U.S. Cl. ..... 323/303; 323/266; 323/283; 323/288

(58) Field of Search ..... 323/266, 283, 323/284, 288, 303; 363/60; 327/530, 535, 538, 540, 536

(56) References Cited

U.S. PATENT DOCUMENTS

| | | | |
|---|---|---|---|
| 4,377,781 | 3/1983 | Tatsushi et al. | 323/299 |
| 4,428,020 | 1/1984 | Blanchard, Jr. | 361/90 |
| 5,153,855 | 10/1992 | Konishi | 365/229 |
| 5,373,227 | 12/1994 | Keeth | 323/313 |
| 5,483,152 | 1/1996 | Hardee et al. | 323/314 |
| 5,497,117 | 3/1996 | Nakajima et al. | 327/404 |
| 5,528,129 | 6/1996 | Kaneko et al. | 323/313 |
| 5,530,395 | 6/1996 | Ting | 327/543 |
| 5,537,065 | 7/1996 | Torgerson | 327/50 |
| 5,537,077 | 7/1996 | Schnizlein | 327/589 |
| 5,548,227 | 8/1996 | Minami | 326/33 |
| 5,781,000 * | 7/1998 | Saeki et al. | 323/283 |

* cited by examiner

*Primary Examiner*—Shawn Riley
(74) *Attorney, Agent, or Firm*—David K. Lucente

(57) ABSTRACT

A method and apparatus for providing a constant output power supply that is different from a system power supply. A system power supply voltage is sensed and compared to a predetermined output voltage value. If the supply voltage is greater than the voltage value, the supply voltage is decreased, such as through regulation. If the supply voltage is less than the votlage value, the supply voltage is increased, such as through charge pumping. The apparatus is preferably coupled between a system power supply and a circuit that operates on a voltage that is different from the supply voltage.

27 Claims, 3 Drawing Sheets

AUTOMATIC POWER SUPPLY SENSING WITH ON-CHIP REGULATION

FIELD OF THE INVENTION

The present invention relates to integrated circuits and more particularly to an automatic power supply sensing device that provides a constant power output.

BACKGROUND OF THE INVENTION

Current electronic systems (e.g., computers) often have different power supply voltages available on a single printed circuit board. Present power supply voltages are typically 3.3 V, 5 V, 6 V, 9.6 V and 12 V. In other cases, a particular integrated circuit (IC) may be designed for use in different applications having different power supply voltages. In either case, the IC must be able to operate at the different power supply voltages. Either special power supply conditioning must be provided for that particular IC or the IC by itself must operate at multiple power supply voltages with no degradation in performance. This can at least add time to the design cycle or cost to the system.

Accordingly, a need exists for a device that can provide a constant power output regardless of the system power supply provided to the device, while minimizing additional cost or design cycle time. The present invention meets this need.

SUMMARY OF THE INVENTION

The present invention includes a power supply sensor and constant power supply output device coupled to receive a power supply to provide an output voltage that is different from the power supply voltage. A circuit can be coupled to receive the output voltage. The power sensor and constant power output device preferably includes a sense and management block and an integrated circuit power supply.

The sense and management block preferably includes a power supply voltage sensor, a control block and a feedback device. The power supply voltage sensor can be an analog-to-digital converter. The control block stores a predetermined value that corresponds to an output voltage for comparison to an output of the power supply voltage sensor. The control block provides an enable signal in response to the comparison. The control block also provides an output to the feedback device in response to the power supply voltage and the stored output voltage. The feedback device is preferably a digital-to-analog converter.

The integrated circuit power supply includes a device, or devices, that provides an output voltage that is either less or greater than the power supply voltage. To this end, the integrated circuit power supply preferably includes at least one regulator. The integrated circuit power supply can also include a charge pump.

The present invention also includes a method of providing a desired output voltage. This method includes the steps of sensing a final voltage value once a system power supply has settled and determining a voltage provided by the system power supply. The method provides an enable signal responsive to the determined voltage and also provides feedback responsive to the desired output voltage, the output voltage and the system power supply voltage. Further provided is a voltage reference and the desired output voltage responsive to the system power supply voltage, the enable signal, the feedback and the voltage reference. The method further includes forcing an integrated circuit power to ground as the system power supply is ramped to a final voltage value. The step of providing the desired output votlage includes either increasing or decreasing the system power supply votlage.

Numerous other advantages and features of the present invention will become readily apparent from the following detailed description of the invention and the embodiments thereof, from the claims and from the accompanying drawings in which details of the invention are fully and completely disclosed as a part of this specification.

DETAILED DESCRIPTION OF THE PREFERRED EMBODIMENT

Figure 1:
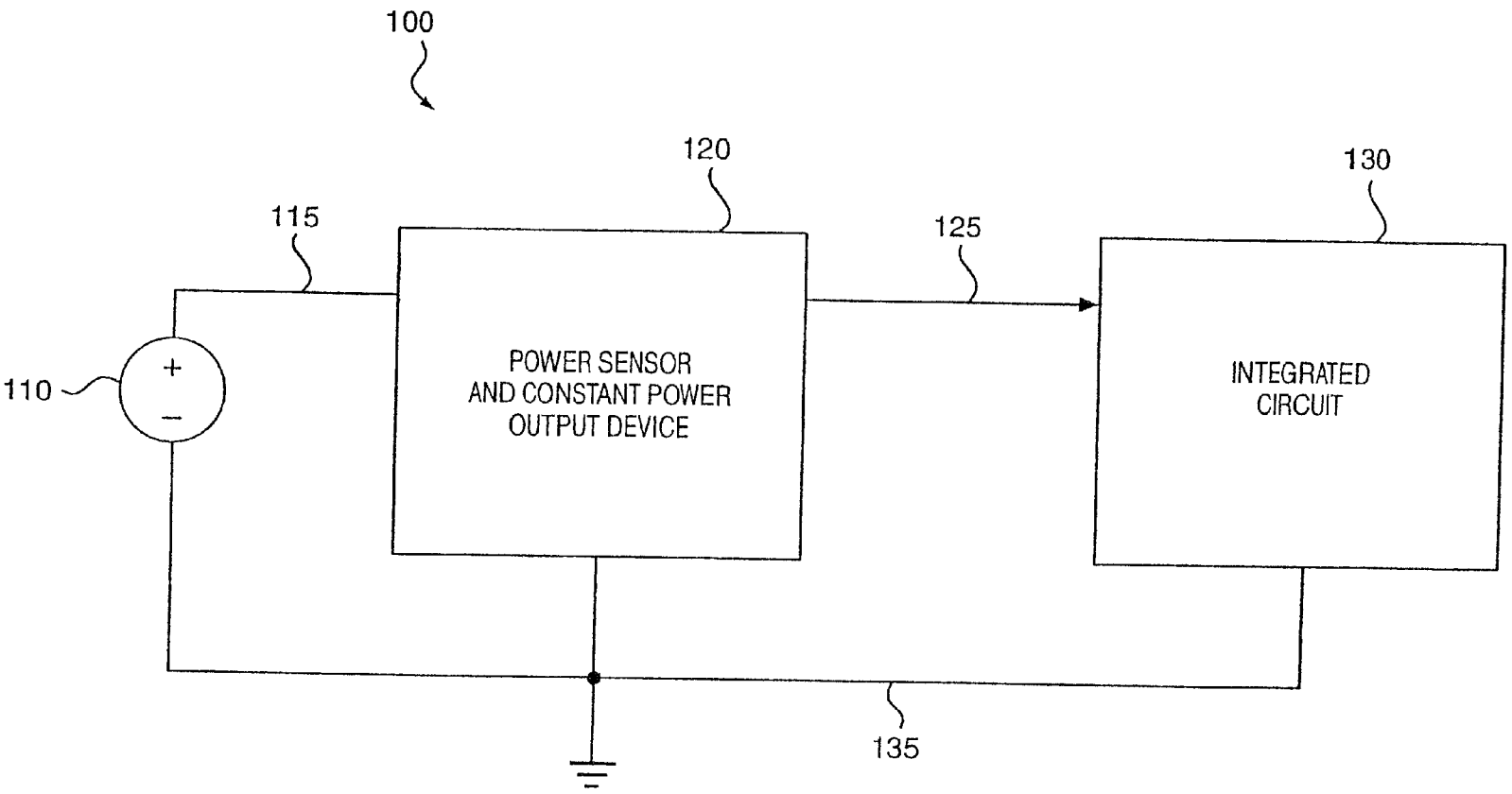
FIG. 1 is a block diagram of a system incorporating the present invention.

While this invention is susceptible of embodiment in many different forms, there is shown in the drawings and will be described herein in detail a specific embodiment thereof with the understanding that the present disclosure is to be considered as an exemplification of the principles of the invention and is not to be limited to the specific embodiment described.

The present invention includes an apparatus and method for providing a power supply independent integrated circuit that automatically senses the available system power supply and generates a constant power supply to an integrated circuit. In this manner, the integrated circuit functions and performs at a constant level regardless of the system power supply. The system power supply can provide power that is greater than or less than the desired power to the integrated circuit.

FIG. 1 illustrates a system 100 that includes a system power supply 110, a power sensor and constant power output device 120 and an integrated circuit 130. System power supply 110 is coupled to device 120 via a lead 115. Device 120 is coupled to integrated circuit 130 via a lead 125. Supply 110, device 120 and circuit 130 are coupled to ground via a lead 135.

The overall operation of system 100 will be explained by way of example. System power supply 110 provides 5 V while integrated circuit 130 operates at 3.3 V. These types of power supply voltages can be respectively attributed to the process technology of another integrated circuit (not shown) in system 100 and integrated circuit 130. Power sensor and constant power output device 120 senses the 5 V and provides a constant 3.3 V by regulating the 5 V. Conversely, if power supply 110 provides 3.3 V and integrated circuit 130 operates at 5 V, then power sensor and constant power output device 120 provides a constant 5 V by charge pumping the 3.3 V to 5 V. Device 120 is configurable to provide different power outputs.

Figure 2:
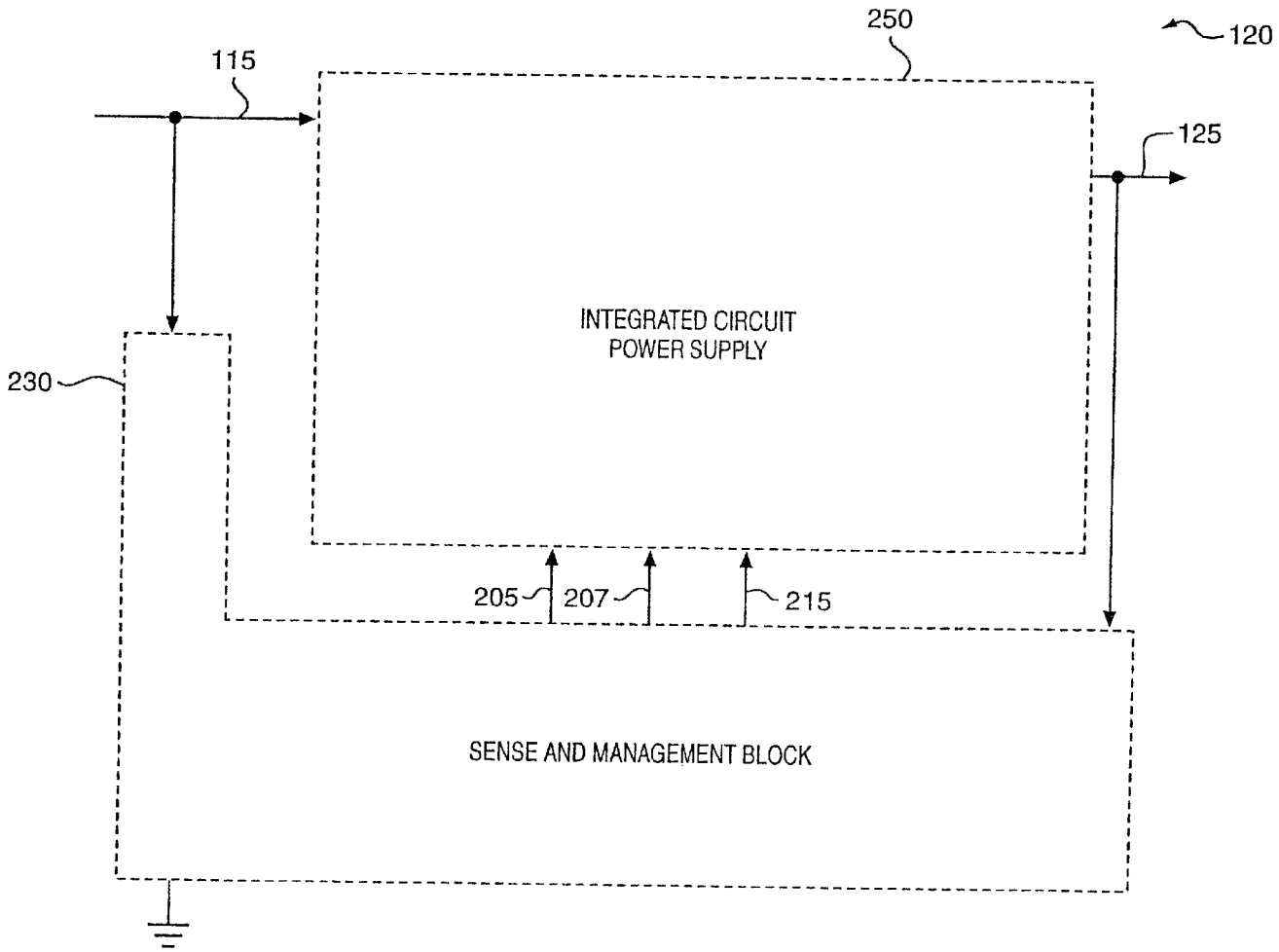
FIG. 2 is a block diagram of the present invention.

FIG. 2 illustrates power sensor and constant power output device 120 as preferably including a sense and management block 230 coupled to an integrated circuit power supply 250. Sense and management block 230 preferably detects the system power supply voltage from lead 115 and determines whether the system power supply voltage is greater than, equal to or less than the desired output voltage of integrated circuit power supply 250. Once the system power supply voltage is determined, sense and management block 230 provides a signal, preferably an enable signal, that represents whether the system power supply voltage is greater than, equal to or less than the desired output voltage of integrated circuit power supply 250. Sense and management block 230 also provides a feedback signal that represents a "correction" value, preferably a voltage. Integrated circuit power supply 250 supplies the desired output voltage in response to the received enable and feedback signals via leads 205, 207 and 215.

Figure 3:
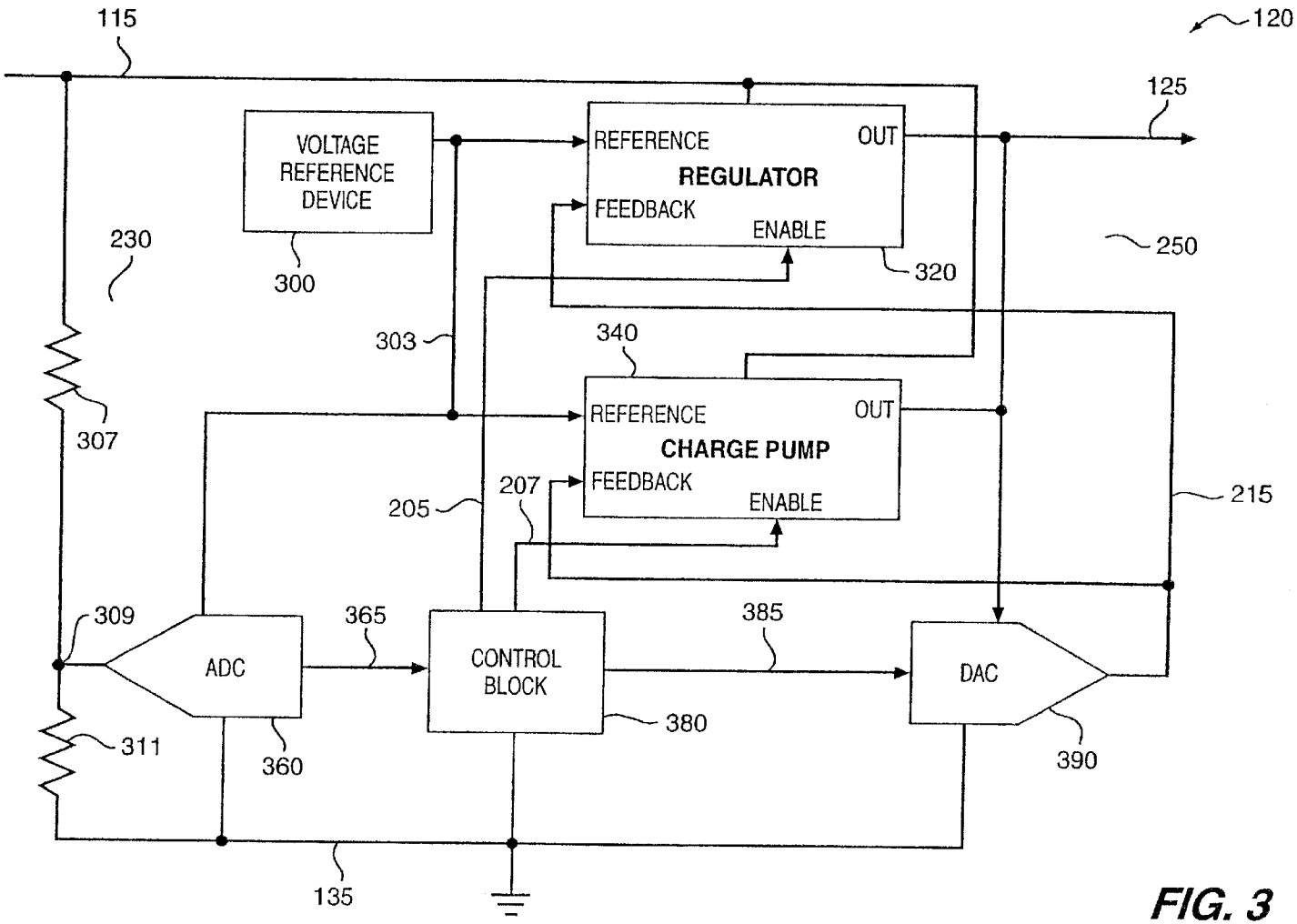
FIG. 3 is a schematic diagram of the present invention.

FIG. 3 shows a more detailed block diagram of power sensor and constant power output device 120 of FIG. 1. Power sensor and constant power output (PSCPO) device 120 preferably includes a voltage reference device 300, a regulator 320 and a charge pump 340, which are included in integrated circuit power supply 250 (shown by dashed lines). Also included in PSCPO device 120 are an analog-to-digital converter (ADC) 360, a control block 380 and a digital-to-analog converter 390, which are included in sense and management block 230 (shown by dashed lines). A system power supply 110 (FIG. 1) provides a voltage on lead 115 to regulator 320, charge pump 340, ADC 360 and a resistor 307. Resistor 307 is coupled to a node 309, which is coupled to a resistor 311. Resistor 311 is connected to ground as illustrated via lead 135.

ADC 360 is coupled to node 309, and control block 380 via a lead 365. Control block 380 is coupled to DAC 390 via a lead 385. Control block 380 is also coupled to the enable ports of regulator 320 and charge pump 340 via lead 205. DAC 360, control block 380 and DAC 390 are coupled to ground via lead 135 as shown. DAC 390 is coupled to the feedback ports of regulator 320 and charge pump 340 via lead 215. DAC 390 is also coupled to lead 125.

Voltage reference device 300 is coupled to the reference ports of regulator 320, charge pump 340 and a reference port of ADC 360 via a lead 303. Regulator 320 or charge pump 340 provide integrated circuit power via lead 125. Regulator 320 can be a universal or "buck" regulator, or a series of regulators that are coupled to the system power supply and generate a desired integrated circuit power. For example, a standard linear pass regulator can be used when the desired integrated power is less than the power provided by system power supply. Regulator 320 can be any device that provides a voltage that is less than the power supply voltage.

A capacitive charge pump can be used to generate the desired integrated circuit power when the power provided by the system is less than that desired power. Alternatively, a "boost" regulator can be substituted for charge pump 340. Or charge pump 340 can be any device that provides an output voltage that is greater than the power supply voltage.

The operation of the present invention will be explained with reference to FIG. 3. Initially, either regulator 320 or charge pump 340 force the integrated circuit power on lead 125 to ground as the system power supply is ramped to a final voltage value. The final voltage value is sensed by ADC 360 once the system power supply has settled. Alternatively, a series of fixed voltages and comparators can be substituted for ADC 360. ADC 360 outputs a digital signal to control block 380 that corresponds to the final voltage value.

Control block 380 determines the voltage provided by the system power supply by the received digital signal. Control block 380 then provides an enable signal on lead 205 to regulator 320 when the determined voltage is greater than or equal to the desired voltage provided by the integrated circuit power. Otherwise, control block 380 provides an enable signal on lead 207 to charge pump 340 when the determined voltage is less than the desired voltage provided by the integrated circuit power. Preferably, control block 380 is programmed with a value representing the desired output voltage on lead 125.

DAC 390 is used to adjust a feedback voltage to either regulator 320 or charge pump 340 to control the output voltage of the integrated circuit power to a desired level. The feedback voltage output from DAC 390 depends on the desired output voltage and the system power supply voltage. Control block 380 determines the digital voltage value to provide to DAC 390 based on the digital signal from ADC 360 and the programmed output voltage value. The feedback voltage from DAC 390 is compared to a voltage reference provided from voltage reference supply 300 in either regulator 320 or charge pump 340. The voltage reference supply 300 is set to output a voltage reference that will generate a desired output voltage on lead 125. In response, the enabled regulator 320 or charge pump 340 adjusts the actual output voltage on lead 125 until it equals the desired output voltage. This equality is achieved when the feedback and reference voltages are equal. As a result, a wide range of output voltages can be provided. A programmable resistive circuit can be substituted for DAC 390.

A digital signal ADC code, which corresponds to the power supply voltage, provided from ADC 360 is determined from the following equation:

$$\text{ADC code}=((V_{SYSPWR}R_{311}/R_{307}+R_{311})/V_{REF})\times FS \quad (1),$$

where $V_{SYSPWR}$ is the voltage of the system power supply, $R_{307}$ is the resistance of resistor 307, $R_{311}$ is the resistance of resistor 311, $V_{REF}$ is the voltage reference provided by voltage reference generator 300 and FS has a value between 1 to $2^4$ where N is the number of bits chosen for analog-to-digital resolution. Preferably, $2^N$ equals 256.

The feedback voltage from DAC 390 is determined from the following equation:

$$V_{FB}=(\text{DAC code}/\text{FS})\times V_{OUT} \quad (2),$$

where DAC code is a digital value determined by and provided from control block 380, FS has a value between 1 to 256 (or $2^N$) and $V_{OUT}$ is the output voltage of the integrated circuit power provided on lead 125. $V_{OUT}$ is equal to $KV_{REF}$ where K is a constant dictated by either regulator 320 or charge pump 340. $V_{REF}$ is provided by voltage reference device 300.

The present invention is particularly advantageous for use in a system having legacy devices requiring one power supply voltage and devices incorporating newer process technology requiring a lower power supply voltage. Such system is exemplified by a computer. The present invention can be used as a stand alone product, so that it interfaces between one power supply and a device. Alternatively, the present invention can be incorporated onto a device with minimal design, manufacturing and economic costs. Such a device can then can be used universally without regard to the system power supply voltage.

Numerous variations and modifications of the embodiment described above may be effected without departing from the spirit and scope of the novel features of the invention. It is to be understood that no limitations with respect to the specific device illustrated herein are intended or should be inferred. It is, of course, intended to cover by the appended claims all such modifications as fall within the scope of the claims.

I claim:

1. An electronic system comprising a power sensor and constant power output device coupled to receive a power supply voltage to provide a desired output voltage responsive to a comparison of the power supply voltage to a value corresponding to the desired output voltage.

2. The system of claim 1 further comprising a circuit coupled to receive the desired output voltage.

3. The system of claim 1 wherein the power sensor and constant power output device includes:

a sense and management block coupled to receive the power supply voltage and the desired output voltage; and an integrated circuit power supply coupled to the sense and management block and coupled to receive the power supply voltage, wherein the integrated circuit power supply provides the desired voltage.

4. The system of claim 3 wherein the sense and management block includes:

a power supply voltage sensor coupled to receive the power supply voltage;

a control block coupled to the sensor and that provides an enable signal; and a feedback device coupled to an output of the integrated circuit power supply and coupled to the control block, wherein the feedback device provides a feedback signal.

5. The system of claim 4 wherein the power supply voltage sensor is an analog-to-digital converter.

6. The system of claim 4 wherein the control block stores the value that corresponds to the output voltage for comparison to an output of the power supply voltage sensor.

7. The system of claim 6 wherein the control block provides an enable signal in response to the comparison.

8. The system of claim 6 wherein the control block provides an output to the feedback device in response to the power supply voltage and the stored value that corresponds to the output voltage.

9. The system of claim 3 wherein the feedback device is a digital-to-analog converter.

10. The system of claim 3 wherein the integrated circuit power supply includes a device that provides an output voltage that is less than the power supply voltage.

11. The system of claim 3 wherein the integrated circuit power supply includes a device that provides an output voltage that is greater than the power supply voltage.

12. The system of claim 3 wherein the integrated circuit power supply includes at least one regulator.

13. The system of claim 5 wherein the integrated circuit power supply includes a charge pump.

14. A system comprising:

a power supply providing a power supply voltage;

a circuit operable by a circuit voltage that is different from the power supply voltage;

an integrated circuit power supply coupled to the power supply and the circuit to provide the circuit voltage; and a sense and management block coupled to the power supply and the integrated circuit power supply to control the circuit voltage responsive to a comparison of the power supply voltage and a predetermined value that corresponds to the circuit voltage.

15. The system of claim 14 wherein the sense and management block includes:

a power supply voltage sensor;

a control block coupled to the sensor; and a feedback device coupled to the control block.

16. The system of claim 14 wherein the integrated circuit power supply includes a device that provides an output voltage that is less than the power supply voltage.

17. The system of claim 14 wherein the integrated circuit power supply includes a device that provides an output voltage that is greater than the power supply voltage.

18. A method of providing an output voltage that is different from a power supply voltage comprising the steps of:

determining whether the power supply voltage is different from a predetermined value for the output voltage; and converting the power supply voltage to the output voltage.

19. The method of claim 18 wherein the determining step includes determining if the power supply voltage is greater or lesser than the predetermined value for the output voltage.

20. The method of claim 18 wherein the step of converting includes decreasing the power supply voltage to the predetermined value for the output voltage.

21. The method of claim 20 wherein the decreasing includes regulating the power supply voltage.

22. The method of claim 18 wherein the step of converting includes increasing the power supply voltage to the predetermined value for the output voltage.

23. The method of claim 22 wherein the step of increasing includes charge pumping to the predetermined value for the output voltage.

24. A method of providing a desired output voltage comprising the steps of:

determining whether a voltage provided by a system power supply is equal to a value corresponding to the desired output voltage;

providing an enable signal responsive to the determined voltage;

providing feedback responsive to the desired output voltage, the output voltage and the system power supply voltage;

and providing the desired output voltage responsive to the system power supply voltage, the enable signal and the feedback.

25. The method of claim 24 further comprising the step of forcing an integrated circuit power to ground as the system power supply is ramped to a final voltage value.

26. The method of claim 24 wherein the step of providing the desired output voltage includes decreasing the system power supply voltage.

27. The method of claim 24 wherein the step of providing the desired output voltage includes increasing the system power supply voltage.

* * * * *